United States Patent [19]

Thominet et al.

[11] Patent Number: 5,004,146

[45] Date of Patent: Apr. 2, 1991

[54] PORTABLE, COLLAPSIBLE CELLULAR RACK

[76] Inventors: Maurice Thominet; Rosemarie Thominet, both of 704 Crane Blvd., Libertyville, Ill. 60048

[21] Appl. No.: 395,355

[22] Filed: Aug. 17, 1989

[51] Int. Cl.[5] ..... B65D 5/48

[52] U.S. Cl. ..... 229/120.31; 229/120.37

[58] Field of Search ..... 217/21, 22, 30, 32, 217/33; 224/42.42, 906; 229/120.02, 120.31, 120.36, 120.37, 120.38

[56] References Cited

U.S. PATENT DOCUMENTS

| | | | |
|---|---|---|---|
| 284,252 | 9/1883 | Smith | 217/33 |
| 639,269 | 12/1899 | McMillin | 229/120.31 OR |
| 734,217 | 12/1903 | Bloomer | 229/120.31 X |
| 901,858 | 12/1908 | Williams | 229/120.31 X |
| 930,835 | 12/1909 | Brown | 229/120.31 X |
| 1,971,863 | 12/1933 | Lupton | 229/120.31 X |
| 2,046,985 | 12/1935 | Wilkins | 229/120.31 X |
| 2,063,720 | 12/1936 | Blau | 229/120.31 |
| 2,549,801 | 4/1951 | George | 229/120.31 |
| 2,549,802 | 4/1951 | George | 229/120.31 X |
| 3,079,040 | 2/1963 | Vesak | 229/120.38 |
| 3,404,818 | 10/1968 | Miscoe | 224/42.42 |
| 3,425,615 | 2/1969 | Wood | 229/120.31 X |
| 3,425,616 | 2/1969 | Adams | 229/120.31 X |
| 3,580,471 | 5/1971 | Burke | 229/120.31 |
| 3,986,656 | 10/1976 | November | 217/22 |
| 4,067,492 | 10/1976 | Grogan | 229/120.25 OR |
| 4,317,537 | 3/1982 | Nauheimer | 229/120.37 OR |
| 4,351,471 | 9/1982 | Dunkle | 229/120.37 |
| 4,621,764 | 11/1986 | Ragon | 229/120.31 OR |
| 4,756,469 | 1/1987 | Hanson | 229/120.31 X |
| 4,793,548 | 2/1988 | Ross | 229/120.36 OR |
| 4,795,083 | 3/1989 | Johnske | 229/120.36 OR |
| 4,836,367 | 4/1989 | Golkan | 229/120.02 X |
| 4,850,529 | 5/1989 | Blackman | 229/120.31 X |

FOREIGN PATENT DOCUMENTS

| | | | |
|---|---|---|---|
| 1536310 | 1/1970 | Fed. Rep. of Germany | 229/120.36 |
| 1417280 | 10/1965 | France | 229/120.36 |
| 2484367 | 12/1981 | France | 229/120.36 |
| 725086 | 3/1955 | United Kingdom | 229/120.36 |

OTHER PUBLICATIONS

Distribution Packaging by Friedman & Kipners, Robert E. Krieger Publishing Co., 1977, pp. 66 and 67.

*Primary Examiner*—Gary E. Elkins

[57] ABSTRACT

A portable collapsible cellular rack for use and stowage within an automobile trunk or the like, which can be instantly opened to provide properly sized cells to accommodate bagged groceries in an upright position during transit, or can be quickly closed by collapsing on its side for stowing without the need for any tools, added parts, or hardware.

3 Claims, 2 Drawing Sheets

PORTABLE, COLLAPSIBLE CELLULAR RACK

This invention relates to cellular racks and particularly to collapsible shopping arrangers for holding bagged groceries in a convenient upright position during transit within an automotive vehicle.

Heretofore, various sized carton boxes have generally been utilized to transport bagged groceries, but sudden changes in direction or movement can result in said box to slide and turn over, thereby spilling and/or damaging the contents. Further, when not in use these bulky boxes create a storage problem. Prior Art attempts to solve these problems have many shortcomings including suggested solutions that are both inconvenient for use, and improperly sized to fit within the confined trunk spaces available in currently manufactured automobiles.

Broadly, it is an object of this invention to provide a grocery shopping convenience device for use and stowing within an automobile trunk or passenger van cargo space, and which overcomes the shortcomings of the prior art. Specifically, it is an object to provide a portable collapsible cellular rack when open for operative use, accommodates each bag of groceries within a properly sized rectangular shaped individual open cell for holding in an upright position against movement during transit, and after use, to be quickly closed in a relatively flat configuration by collapsing for convenient stowing, without the need for any tools, added parts or hardware. The stated simple procedure for closing the rack is to be reversed for operative use. Although this rack must be capable of being opened or closed numerous times, it must provide durable use and be economical to produce.

A device demonstrating the objects and advantages of this present invention, has components fabricated from corrugated fiberboard strip stock, which comprise a perimeter with four (4) sides forming a rectangle, each side foldable and hinged at the intersection of the adjacent sides and with a folded end for interconnecting, together with two (2) cross partitions each provided with a medial located oversized slot and a fold line for hinging near each end, and a middle partition provided with appropriately located oversized slots for interlocking with the slots of the cross partitions, as well as a fold line for hinging at each end. For assembly, the cross partitions are first interlocked, then all folded hinged ends are arranged in the same clockwise or counterclockwise direction, and attached to the interior of the rectangular shaped perimeter component, thereby forming six (6) open cells, each sized with proper clearances for the placement and removal of an upright bag of groceries, when in an erect operative use.

The described assembly of interlocked partitions equipped with oversized slots provided for flexibility, in combination with their hinged ends arranged in the same direction for attachment to the perimeter, enables the rack to be repeatedly closed in a relatively flat configuration without distortion to any component.

The four (4) formed exterior panels of the perimeter component are utilized for advertising, with two (2) of said panels always being visible, even when the rack is closed for stowing.

Readers will find further advantages and features of this invention from the ensuing description and accompanying drawings.

DRAWING AND FIGURES WITH BRIEF DESCRIPTION

DRAWING REFERENCE NUMERALS WHERE SHOWN FOR FIGS. 1, 2 AND 3

Figure 1:
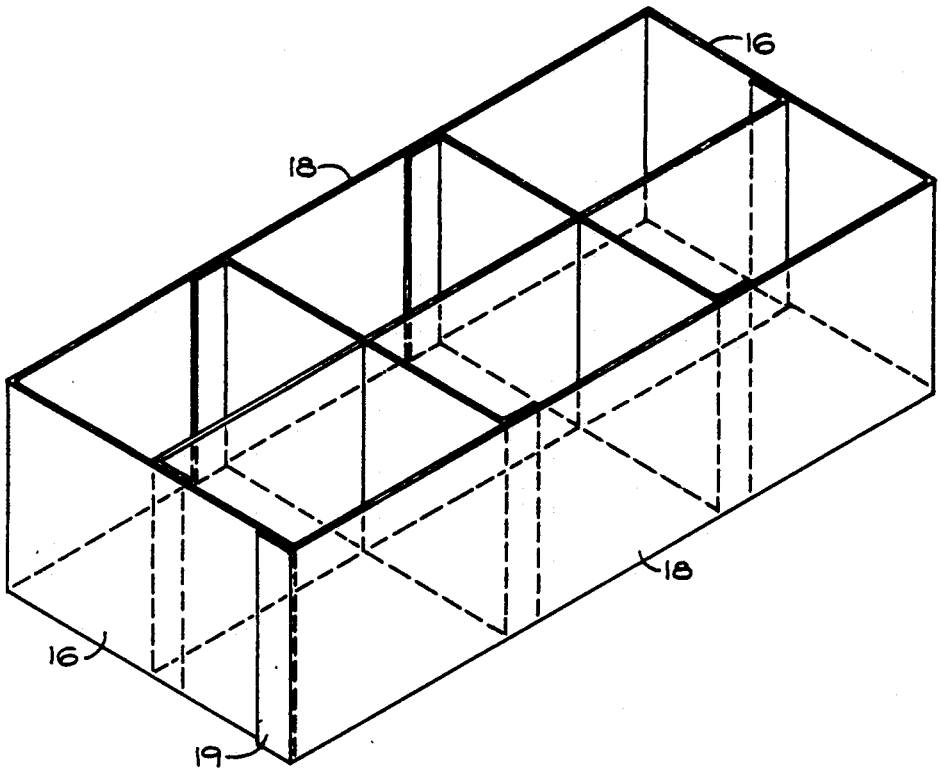
FIG. 1 shows an isometric view of an assembled rack open for use.
Figure 2:
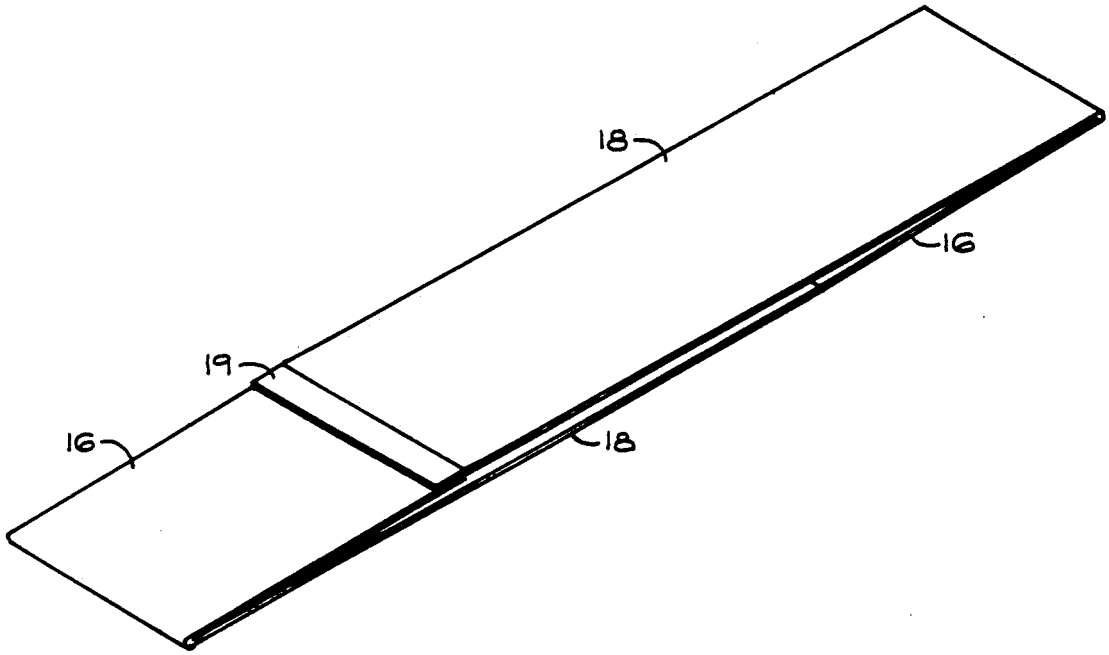
FIG. 2 shows an isometric view of the same rack collapsed and closed for stowing.

10. perimeter component
11. middle partition component
12. cross partition components, two required
13. interlocking slots oversized for flexibility in items 11 and 12
14. folded hinge corner, typical for closing or opening rack
15. partition guide marks, typical or interior of item 10 perimeter component
16. advertising panels provided on short sides of exterior of 10 perimeter component
17. folded end for attachment
18. advertising panels provided on long sides of exterior of 10 perimeter component
19. folded end for interconnecting panels to form a continuous perimeter Reference is now made to the drawings wherein a portable collapsible cellular rack for use and stowing within an automobile trunk is shown in FIG. 1 in an operative erect condition exposing open cells, sized to hold one grocery bag within each cell in an upright position against movement during transit, thereby preventing damage to fragile items, as well as the gathering of articles from every nook and cranny of a vehicle as a result of an overturned bag. As illustrated in FIG. 2, after each operative use, said rack is quickly closed by turning on one of the long side panels 18, and collapsing in an accordion manner to achieve a relatively flat configuration for convenient stowing within said automobile trunk, thereby permitting the trunk to also be utilized for additional purposes. The rack is quickly returned for operative use by reversing the stated procedure for closing.

Figure 3:
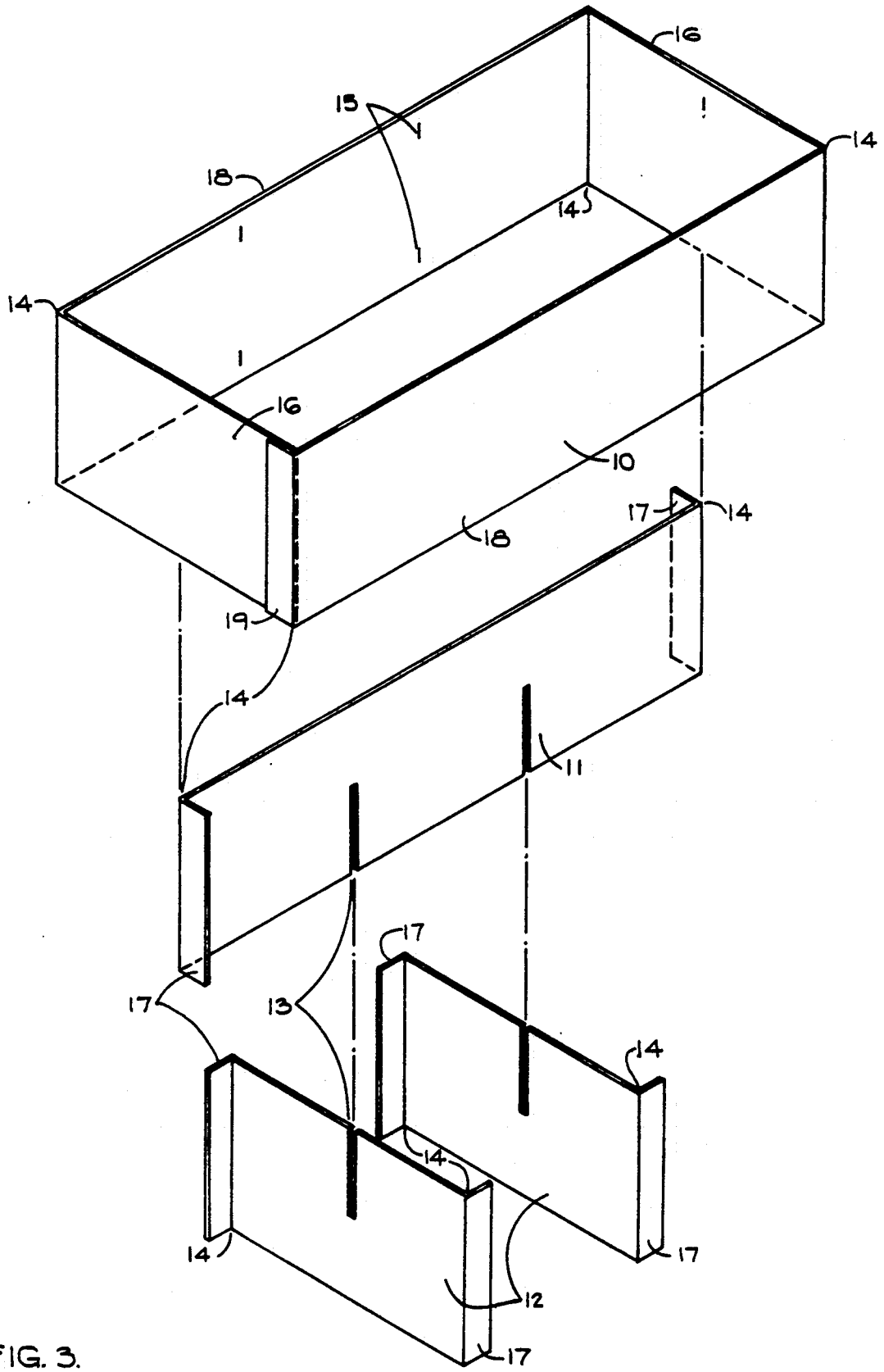
FIG. 3 shows an exploded isometric view of the four (4) components, and details for their fabrication and assembly.

As illustrated in FIG. 3, the rack components are fabricated of corrugated fiberboard strip stock, comprised of a pair of cross partitions 12, a middle partition 11, and a perimeter 10. Each said cross partition 12 is Z shaped and has fold lines 14 for hinging each end 17, and a medial oversized slot 13 located in the upper portion for engaging the middle partition 11, which is also Z shaped with fold lines 14, for hinging each said end 17, and appropriately located oversized slots 13, located in the lower portion for interlocking with the corresponding slot of each said cross partition. Said hinged ends 17, of each said cross and middle partitions are arranged in a consistent clockwise or counterclockwise direction, and are attached to the interior of said perimeter 10 at marked guides 15. Said perimeter 10 is comprised of an elongated rectangular strip with four hinged corners 14 forming two short panels 16, and two long side panels 18, with a folded end 19, for interconnecting the opposite ends to thereby form a continuous perimeter. Said cross and middle partitions are permanently attached by suitable means at guide marks 15 located on the interior of said perimeter, t hereby forming the rack to achieve open cells within the areas bounded by said perimeter 10, and occupied said middle partition 11, said cross partitions 12, for upright transit of grocery bags when in an operative erect condition. Said assembled rack as shown Open for Use in FIG. 1, can be quickly collapsed as shown Closed for Stowing in FIG. 2, without the need for any tools, added parts, or hardware.

The exterior of formed perimeter 10, provides four flat surfaces both suitable and valuable for advertising and/or decorative art, shown as 16 and 18 on FIG. 3, with two of said panels being visible at all times within an automobile trunk, even when said rack is in a collapsed condition, as shown in FIG. 2 closed for stowing. The advertising value of said panels for business establishments, organizations, a sponsor's message, or other products is achieved each time said rack is closed or opened by a purchaser during the anticipated life of this device. Suitable printing methods with a myriad of colors provide sponsors with various choices to satisfy individual requirements.

As noted hereinafter, the invention shown and described is to be taken as illustrative only, and changes in the number of individual cells, and/or their arrangement, or the use of technological advances in materials, fabrication or assembly may be made while achieving the same effect without departing from the spirit and scope of the invention.

What is claimed is:

1. A portable collapsible cellular rack for use and storage within an automobile trunk having an operative erect condition exposing cells sized to hold one grocery bag within each of said cells in an upright position against movement during transit, said rack fabricated of corrugated fiberboard strip stock, comprising a pair of Z shaped cross partitions having fold lines for hinging near each end, and having a medial oversized slot in said cross partitions for engaging a Z shaped middle partition also having fold lines for hinging near each end, and having appropriately located oversized slots for interlocking with said medial slot of each said cross partition, and each said cross partition and said middle partition having each hinged end permanently attached at guide marks on a rectangular strip having four folded corners for hinging, and having a folded end for interconnection forming a perimeter of two short and two long side panels, to thereby form said open cells within the area bounded by said perimeter and occupied said partitions for upright transit of grocery bags, whereby following said operative erect condition, said rack is quickly closed by turning on either one of said long side panels of the perimeter and collapsing in an accordion manner for relatively flat stowing in said automobile trunk so as to be readily available for convenient use by reversing said described procedure for closing, all without the need for any tools, added parts, or hardware.

2. A portable collapsible cellular rack as defined in claim 1, wherein the assembly of said interlocked oversized slots which are medially located in upper portion of said cross partitions and appropriately located in the lower portion of said middle partition, in combination with each hinged end of said partitions arranged in a consistent clockwise or counterclockwise direction and attached to said perimeter as a means of providing flexible connections for all the partitions with the perimeter to achieve repeated collapsing of said rack in a relatively flat manner without distortion to the perimeter.

3. A portable collapsible rack as defined in claim 1, wherein the exterior of said perimeter is comprised of four (4) flat panels suitable for advertising, with two of said panels being visible at all times, even when said rack is in a collapsed condition for stowing within said automobile trunk.

* * * * *